United States Patent [19]

Kulikowski et al.

[11] 4,401,222

[45] Aug. 30, 1983

[54] SUPPORT RAIL

[75] Inventors: Patricia A. Kulikowski, Wyoming; Allen L. Palmbos, Jenison; Charles R. Tyke, Cascade, all of Mich.

[73] Assignee: Westinghouse Electric Corp., Pittsburgh, Pa.

[21] Appl. No.: 271,162

[22] Filed: Jun. 8, 1981

[51] Int. Cl.[3] ..... A47F 5/00

[52] U.S. Cl. ..... 211/94; 211/126; 211/103

[58] Field of Search ..... 211/94, 103, 126, 189, 211/191, 207, 208; 248/243; 52/36

[56] References Cited

U.S. PATENT DOCUMENTS

| | | | |
|---|---|---|---|
| 2,428,073 | 9/1947 | Handel . | |
| 2,691,502 | 10/1954 | Jones | 248/243 |
| 3,031,088 | 4/1962 | Ribbens et al. . | |
| 3,212,646 | 10/1965 | Propst . | |
| 3,496,889 | 2/1970 | Protzmann et al. . | |
| 3,712,698 | 1/1973 | Propst . | |
| 3,886,698 | 6/1975 | Raith et al. | 211/126 X |
| 4,126,230 | 11/1978 | Tyson et al. | 211/189 |
| 4,151,917 | 5/1979 | Pugh | 211/126 |
| 4,155,459 | 5/1979 | Marshak | 211/94 X |
| 4,349,113 | 9/1982 | Schreiner | 211/103 |

*Primary Examiner*—Ramon S. Britts
*Assistant Examiner*—Peter A. Aschenbrenner
*Attorney, Agent, or Firm*—B. R. Studebaker

[57] ABSTRACT

A wall-mounted support rail for mounting and supporting a plurality of paper-handling trays and the like, and which is adapted to be mounted to a pair of laterally spaced, vertical slotted standards. The support rail includes an elongated slot in the front surface which is adapted to receive paper-handling elements of differing construction, and includes mounting clip members on the rear surface adjacent the ends of the rail which interlock with slots in the vertical slotted standards.

4 Claims, 9 Drawing Figures

SUPPORT RAIL

BACKGROUND OF THE INVENTION

This invention relates to a support rail for paper-handling systems and more particularly to a support rail for paper-handling systems utilized in connection with an open office plan, space-dividing system.

In recent years the use of space-dividing wall panel systems, or what is commonly referred to as an "open office plan," has becomore more and more commonplace. A distinct advantage of the open office plan over fixed wall office systems is its mobility and adaptability to change as requirements of the office operations change in terms of size and function or as operations grow and emphases change. Although the open office plan has added greatly to the efficiency of many office organizations, the office has remained primarily a paper-handling and storage operation. Analysis has shown that most offices have similar general requirements, the most predominant of which is the storage and recall of paper work.

The need is clear for the provision of an efficient system for storing and handling paper work which is readily adapted to operate in connection with a typical open plan system. One extremely successful open office system is disclosed in U.S. Pat. No. 3,762,116 issued to William C. Anderson et al. for "Space Divider System and Connector Assembly Therefor," which employs a plurality of cylindrical posts to which space-dividing wall panels are hung to form the confines of individual offices. These space-dividing wall panels, which include slotted vertical standards at the edge of each wall panel, can be readily transformed from a simple panel into a working wall by the judicious attachment thereto of wall-hung cabinets, and a paper-handling and storage system. In connection with utilizing a paper-handling system with a space-dividing wall panel, a critical element is a support mechanism which is readily attachable to the wall panel and has a versatility for receiving and supporting a plurality of differently designed paper-handling and storing devices suitable for the variety of different paper management functions.

SUMMARY OF THE INVENTION

The support rail of this invention, for supporting a plurality of differently constructed paper-handling trays and the like while mounted to a pair of laterally spaced, vertical slotted standards; includes a hollow rectangular rail member having a front wall and a rear wall with the front wall having an elongated slot in the upper portion for the length thereof and communicating with the hollow interior of the rail member. Mounting clip means are secured to the rear surface of the rail adjacent each end thereof with the mounting clip means including connector means thereon constructed and arranged to engage the slotted standards and thereby support the rail member. The rail member preferably includes a web member which interconnects the front and rear walls of the elongated rectangular rail member dividing the hollow interior thereof into upper and lower cavities with the elongated slot communicating with the upper cavity. End cap members close off the open ends of the elongated rail member with the end caps including a closure portion and a pair of tab members extending normal to the closure portion, which tab members extend into the rail member. The rail member also preferably includes upper and lower mounting flanges on the rear surface thereof, and the mounting clip means is an L-shaped bracket having elongated slots in one leg thereof and the connector means on the other leg with the first leg being receivable between the upper and lower mounting flanges on the rail member. Screw means are employed which extend through the elongated slots in the L-shaped bracket, the rear surface of the rail member and apertures in the tab members of the end caps thereby securing both the end cap members and the mounting clip means to the rail member. The portion of the front wall of the rail member above the elongated slot defines a downwardly projecting lip member and the portion of the front wall below the elongated slot defines an upwardly projecting lip member to form attaching means for variously designed paper-handling trays and the like.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
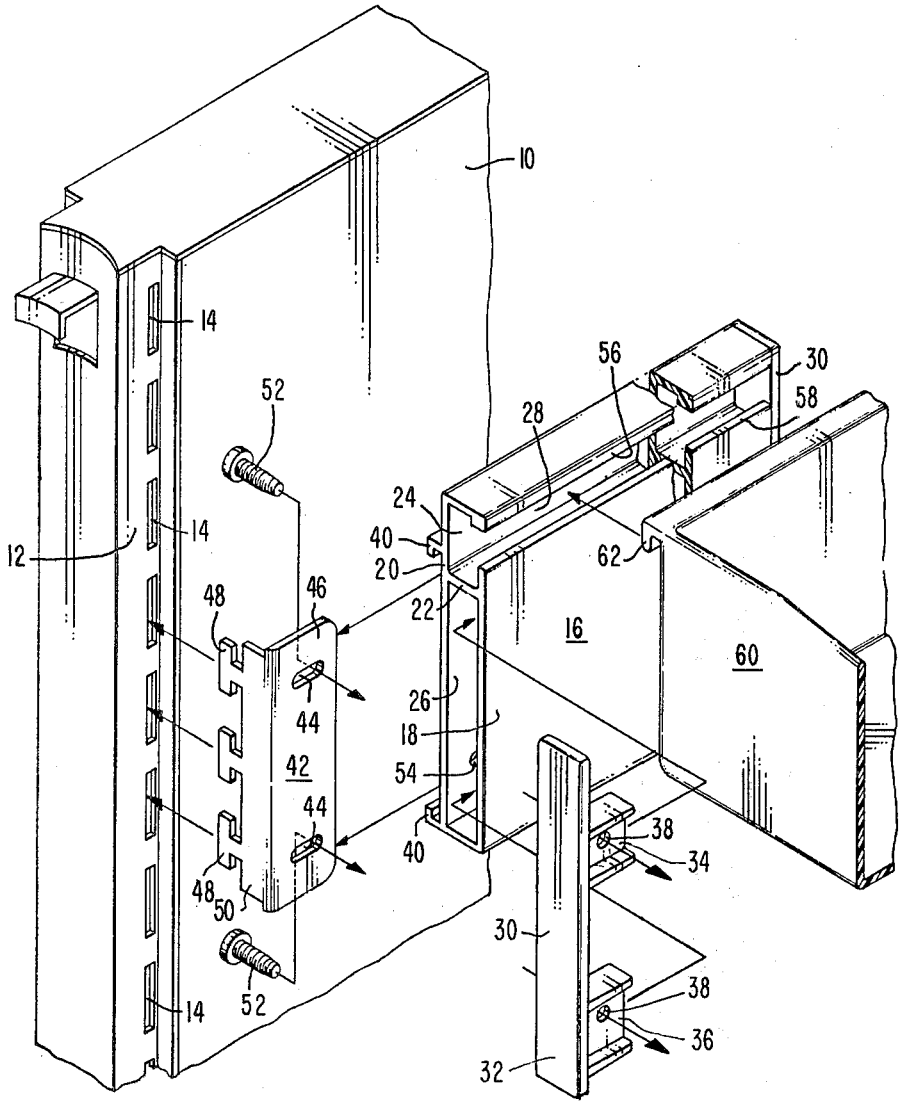
FIG. 1 is an exploded perspective view of a space-dividing wall panel, the support rail of this invention and a paper-handling tray.
Figure 2:
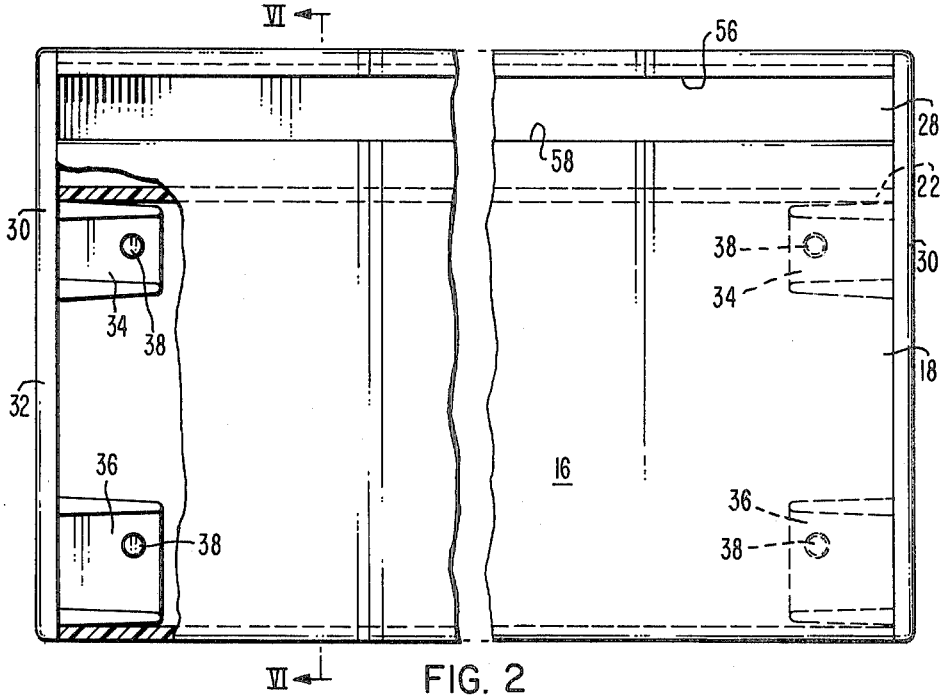
FIG. 2 is a partial front elevation view of the support rail of this invention with a portion of one end broken away.
Figure 6:
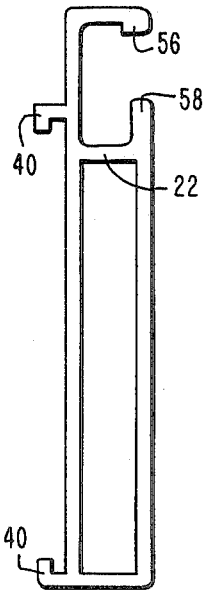
FIG. 6 is a sectional view taken along the line VI—VI of FIG. 2.

Referring now in detail to the drawing wherein like reference characters represent like parts throughout the several views, there is illustrated in FIG. 1 the left-hand side of a typical space-dividing wall panel 10 which has at each end thereof a conventional vertical slotted standard 12 having a series of vertically aligned slots 14 therein.

The support rail for supporting a plurality of differently constructed paper-handling trays and the like is adapted to be mounted to this spaced pair of vertical slotted standards and includes a hollow elongated rectangular rail member 16 which includes a front wall or surface 18 and a back wall or surface 20 with the front wall 18 and rear wall 20 being interconnected by a web portion or member 22 which divides the hollow interior of the rail member into upper and lower cavities 24 and 26. An elongated slot 28 in the upper portion of the front wall extends for the length of the rail member 16 and serves to retain material-handling trays and the like in a manner which will be later described.

Each end of the hollow rail member 16 is closed off by an end cap member 30 which includes a closure portion in the form of a planar end plate 32 and a pair of upper and lower tab members 34, 36. The tab members 34 and 36 are I-shaped in cross section with a circular aperture 38 through the center web portions thereof. The top and bottom portions of the I-shaped tabs are of a width such that they provide a close fit to the interior of the lower hollow portion or cavity 26 of the rail member, and when pressed onto the ends of the rail member, will be releasably retained thereon.

On the back wall 20 of the rail member 16 there are located upper and lower mounting flanges 40 which extend for the length of the rail member and which are adapted to receive therebetween mounting clip means generally designated 42. The mounting clip means 42 is generally an L-shaped bracket having elongated slots 44 in the leg 46 and connector means 48 in the form of T-shaped connectors on the other leg 50. Leg 46 of the L-shaped mounting clip 42 is adapted to slide between the flanges 40, and screws 52 extend through the elongated slots 44 in leg 46, apertures 54 in the rear wall of the rail member and apertures 38 in tab portions 34 and 36 of the end cap members 30. As will be readily apparent, the screws 52 retain the mounting clip on the rear surface of the mounting rail as well as retain the end cap members 30 closing off the hollow open ends of the rail member 16. The elongated slots 44 permit slight relative lateral adjustment of the mounting clip 42 relative to the support rail 16 before the screws 52 are tightened to compensate for slight discrepancies in the spacing between a pair of spaced, parallel vertical slotted standards 12.

The T-shaped connectors 48 are adapted to extend through the slots 14 in the vertical slotted standards 12 and when moved downwardly latch behind the standard in a conventional manner to thereby mount the support rail to the wall panel 10.

The elongated slot 28 in the upper portion of the front wall 18 forms with the front wall and defines a downwardly projecting lip 56 at its upper edge and an upwardly projecting lip member 58 at its lower edge. As will be apparent from FIGS. 6–9, the downwardly projecting lip 56 is preferably thicker than the upwardly projecting lip 58.

Figure 7:
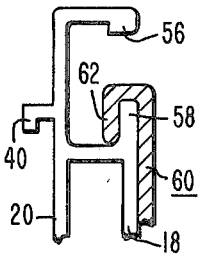
FIGS. 7, 8 and 9 are partial sectional views similar to FIG. 6, illustrating the adaptability of the support rail of this invention for supporting variously designed paper-handling components.

In the preferred method of utilizing the support rail of this invention, a paper-handling tray or the like generally designated 60, having a hook-shaped flange 62 on the rearward upper edge thereof slips over the upwardly projecting lip member 58 and the tray or the like is supported from the rail in a cantilevered fashion. This preferred method of utilizing the rail is best illustrated in FIGS. 1 and 7. Illustrative of two types of paper-handling trays or the like which can be utilized in connection with the support rail of this invention are illustrated in design applications Ser. Nos. 213,696 and 213,697, both filed Dec. 14, 1980, by C. R. Tyke, and owned by the assignee of this invention.

Figure 8:
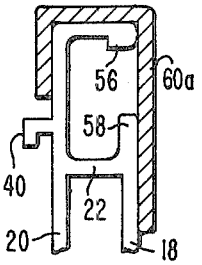
Figure 9:
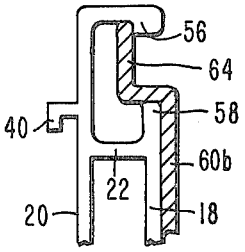
Figure 5:
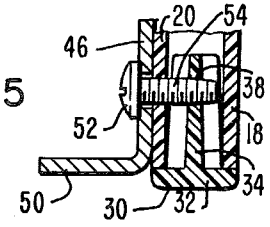
FIG. 5 is a sectional view taken along the line V—V of FIG. 4.
Figure 4:
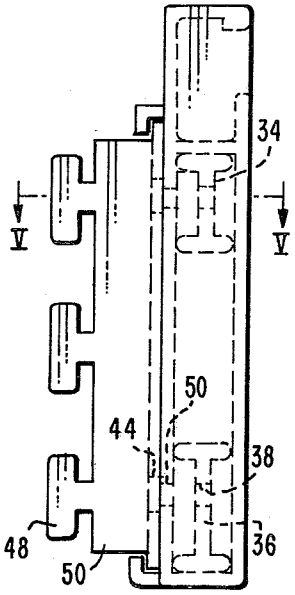
FIG. 4 is an end elevation view with the end cap removed.
Figure 3:
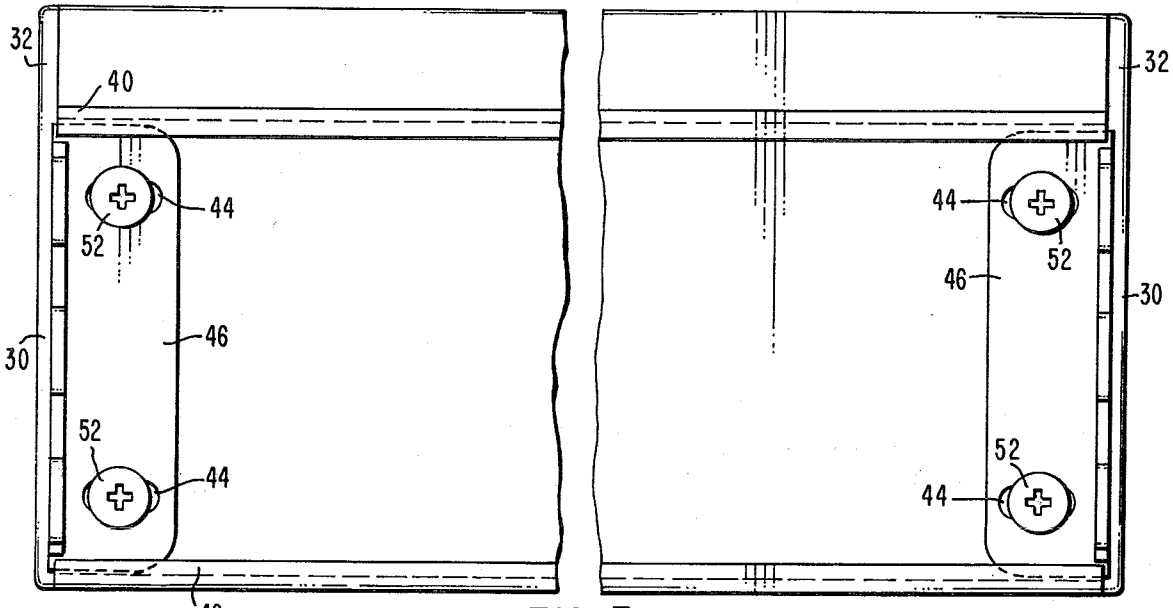
FIG. 3 is a partial rear elevation view thereof.

As illustrated in FIGS. 8 and 9 the support rail of this invention is also capable of supporting paper-handling trays and the like of differing construction than that illustrated in FIG. 7. In FIG. 8, the paper-handling component 60*a* may be retained in a cantilevered fashion over the top of the rail, and in the FIG. 9 configuration, an upwardly extending tab 64 on the tray or component 60*b* slips behind the downwardly projecting lip 56 to thereby retain the material-handling component 60*b* on the support rail.

In the preferred embodiment the support rail 16 is preferably an aluminum alloy extrusion, the end caps 30 are preferably a high-strength plastic, and the clip members 42 are 13-gauge hot-rolled steel.

As will be apparent from the foregoing, the support rail of this invention is extremely versatile in the ability to support paper-handling trays and the like of different constructions, as well as being releasably mounted at selected heights to the slotted standards of a typical space-dividing wall panel system.

What is claimed is:

1. A wall mounted support rail adapted to be mounted to a pair of laterally spaced, vertically oriented slotted standards, said support rail comprising:

an elongated, generally rectangular, rail member including a front wall, a rear wall, a top wall, and bottom wall with a web member interconnecting said front wall and said rear wall dividing the interior of said rail member into an upper cavity and a lower cavity;

an elongated slot in said front wall communicating with said upper cavity, the portion of said front wall above said elongated slot defining a downwardly projecting lip member and the portion of said front wall below said elongated slot defining an upwardly projecting lip member, said downwardly projecting lip member being of a greater thickness than said upwardly projecting lip member; and a pair of mounting clip means having connector means thereon constructed and arranged to interlock with the slots in said slotted standards, and means for mounting one of said pair of mounting clip means at each end of the rear wall of said rail member.

2. A support rail for supporting a plurality of differently constructed paper-handling trays and the like while mounted to a pair of laterally spaced, vertical slotted standards, said support rail comprising:

a hollow elongated rectangular rail member including a front wall and a rear wall, said front wall having an elongated slot in the upper portion for the length thereof and communicating with the hollow interior of said rail member;

end cap members closing off the open ends of said elongated hollow rail member, said end cap members including a closure portion and a pair of tab members extending normal to said closure portion, said tab members having an I-shaped cross section with a circular aperture through the center web thereof; and mounting clip means secured to the rear wall of said rail member adjacent each end thereof, said mounting clip means including connector means thereon constructed and arranged to engage said slotted standards and thereby support said rail member.

3. The support rail according to claim 2 wherein said rail member includes upper and lower mounting flanges on the rear wall thereof, and said mounting clip means is an L-shaped bracket having elongated slots in one leg thereof and said connector means on the other leg thereof, said one leg of said L-shaped bracket being receivable between said upper and lower mounting flanges on said rail member.

4. The support rail according to claim 3 wherein screw means extend through said elongated slots in said L-shaped bracket, said rear wall of said rail member and said apertures in the center web of said tab members thereby securing both said end cap members and said mounting clip means to said rail member.

* * * * *